US009873549B2

(12) United States Patent
Heinz et al.

(10) Patent No.: US 9,873,549 B2
(45) Date of Patent: Jan. 23, 2018

(54) CONTAINER FOR MAILING A PACKAGE OR A SMALL PARCEL TO BE SENT OR TO BE RECEIVED

(71) Applicant: Deutsche Telekom AG, Bonn (DE)

(72) Inventors: Sebastian Heinz, Bonn (DE); Joerg Windheuser, Duesseldorf (DE); Michael Schmidt-Gabriel, Wessling (DE); Johannes Scholl, Munich (DE)

(73) Assignee: DEUTSCHE TELEKOM AG, Bonn (DE)

( * ) Notice: Subject to any disclaimer, the term of this patent is extended or adjusted under 35 U.S.C. 154(b) by 94 days.

(21) Appl. No.: 14/845,329

(22) Filed: Sep. 4, 2015

(65) Prior Publication Data

US 2016/0068306 A1 Mar. 10, 2016

(30) Foreign Application Priority Data

Sep. 4, 2014 (DE) ..... 10 2014 012 879

(51) Int. Cl.

| | |
|---|---|
| ***B65D 21/08*** | (2006.01) |
| ***B65D 43/00*** | (2006.01) |
| ***B65D 81/02*** | (2006.01) |
| ***B65D 85/00*** | (2006.01) |

(Continued)

(52) U.S. Cl.

CPC ..... *B65D 21/086* (2013.01); *A47G 29/141* (2013.01); *A47G 29/20* (2013.01); *B65D 43/00* (2013.01); *B65D 81/02* (2013.01); *B65D 85/70* (2013.01); *A47G 2029/144* (2013.01)

(58) Field of Classification Search

CPC .... B65D 21/086; B65D 33/02; B65D 90/021; A47G 2029/144; A47G 29/20

See application file for complete search history.

(56) References Cited

U.S. PATENT DOCUMENTS 5,215,731 A * 6/1993 Cadwallader ..... C01B 25/418 423/315

6,375,070 B1 4/2002 Snoke (Continued)

FOREIGN PATENT DOCUMENTS

| | | |
|---|---|---|
| CA | 2220810 A1 | 5/1999 |
| DE | 202014000458 U1 | 4/2014 |

(Continued)

*Primary Examiner* — Shawn M Braden

(74) *Attorney, Agent, or Firm* — Leydig, Voit & Mayer, Ltd.

(57) ABSTRACT

A container for mailing a package or a small parcel to be sent or to be received, which container can be fastened to a door of a property, in particular without structural intervention, includes a base element, a lid element by which a mailing can be placed into the container or be removed from the container, and foldable side walls, by which the base element and the lid element are connected to each other. The lid element and the base element are movable against one another, at least in a vertical direction, by folding or at least partially unfolding the foldable side walls. The foldable side walls form a textile tube vertically extending between the base element and the lid element in the unfolded state, the textile tube defining an interior space with an at least substantially horizontal rectangular cross section.

17 Claims, 3 Drawing Sheets

(51) Int. Cl.
*A47G 29/14* (2006.01)
*A47G 29/20* (2006.01)

(56) References Cited

U.S. PATENT DOCUMENTS

| | | | | |
|---|---|---|---|---|
| 7,815,069 | B1 * | 10/2010 | Bellofatto ..... | B65D 81/3886<br>190/903 |
| 9,303,950 | B2 * | 4/2016 | Fuller ..... | F41C 33/06 |
| 2016/0059990 | A1 * | 3/2016 | Patikas-Bryant .... | B65D 21/086<br>220/523 |

FOREIGN PATENT DOCUMENTS

| | | | |
|---|---|---|---|
| DE | 102013005231 | A1 | 10/2014 |
| WO | WO 2014154344 | A1 | 10/2014 |

* cited by examiner

CONTAINER FOR MAILING A PACKAGE OR A SMALL PARCEL TO BE SENT OR TO BE RECEIVED

CROSS REFERENCE TO RELATED APPLICATIONS

This application claims benefit to German Patent Application No. DE 10 2014 012 879.2, filed Sep. 4, 2014, which is hereby incorporated by reference herein.

FIELD

The invention relates to containers for mailing a package or a small parcel to be sent or to be received, which container can be fastened to the door of a property, in particular without structural intervention.

BACKGROUND

Containers for mailing a package or a small parcel are known for example from patent application DE 10 2013 005 231.9. The typical usage area of such containers results from the fact that persons often expect the receipt of packages or small parcels, which do not fit into the usual mailbox arranged at a house or at an apartment or generally at a property.

With a container of the abovementioned type, the person has the possibility to arrange a container at the property temporarily and occasionally, namely concretely in the region of the door, if the person for example expects such a large mailing. A mailman or a parcel carrier has hereby the possibility to insert a mailing which does not fit into the mailbox into this container after opening the lid element and to close the container again hereafter.

As the container itself is fastened irremovably to the property for third parties, there is, apart from forcible action, no possibility to steal the expected mailing in an unauthorized manner.

For fastening such a container, the abovementioned patent application teaches for example the use of a flap, e. g. a flexible textile flap which extends away from the container and which has a thickened region, in particular a thickened end, so that this flap can be guided through a gap region, for example between the door and the frame or between the door and the floor, the thickened region of the flap hereby comes to rest in the interior of the apartment and thus the flap cannot be pulled out from the door region after closing the door. The owner of the apartment or of the house can however release the flap by opening the door and hereby remove the entire container again.

As described here at the outset regarding the possible receipt of a package or of a small parcel mailing, there exists of course also the possibility to insert packages or small parcels or other mailings into the container and to temporarily provide them in front of the house or the apartment door for the collection by a messenger.

The abovementioned patent application already teaches for example to design the side walls of such a container extending between the base element and the lid element in a foldable manner, thus creating the possibility to move the container back and forth between a folded and an unfolded state and thus to provide a large inner volume by e.g. unfolding, into which the package or the small parcel are inserted, whereas the folded state is more space-saving, as the volume is significantly reduced in this state.

SUMMARY

According to an embodiment of the invention, a container for mailing a package or a small parcel to be sent or to be received, which container can be fastened to a door of a property, in particular without structural intervention, is provided. The container comprises a base element, a lid element by which a mailing can be placed into the container or be removed from the container, and foldable side walls, by which the base element and the lid element are connected to each other. The lid element and the base element are movable against one another, at least in a vertical direction, by folding or at least partially unfolding the foldable side walls. The foldable side walls form a textile tube vertically extending between the base element and the lid element in the unfolded state, the textile tube defining an interior space with an at least substantially horizontal rectangular cross section.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
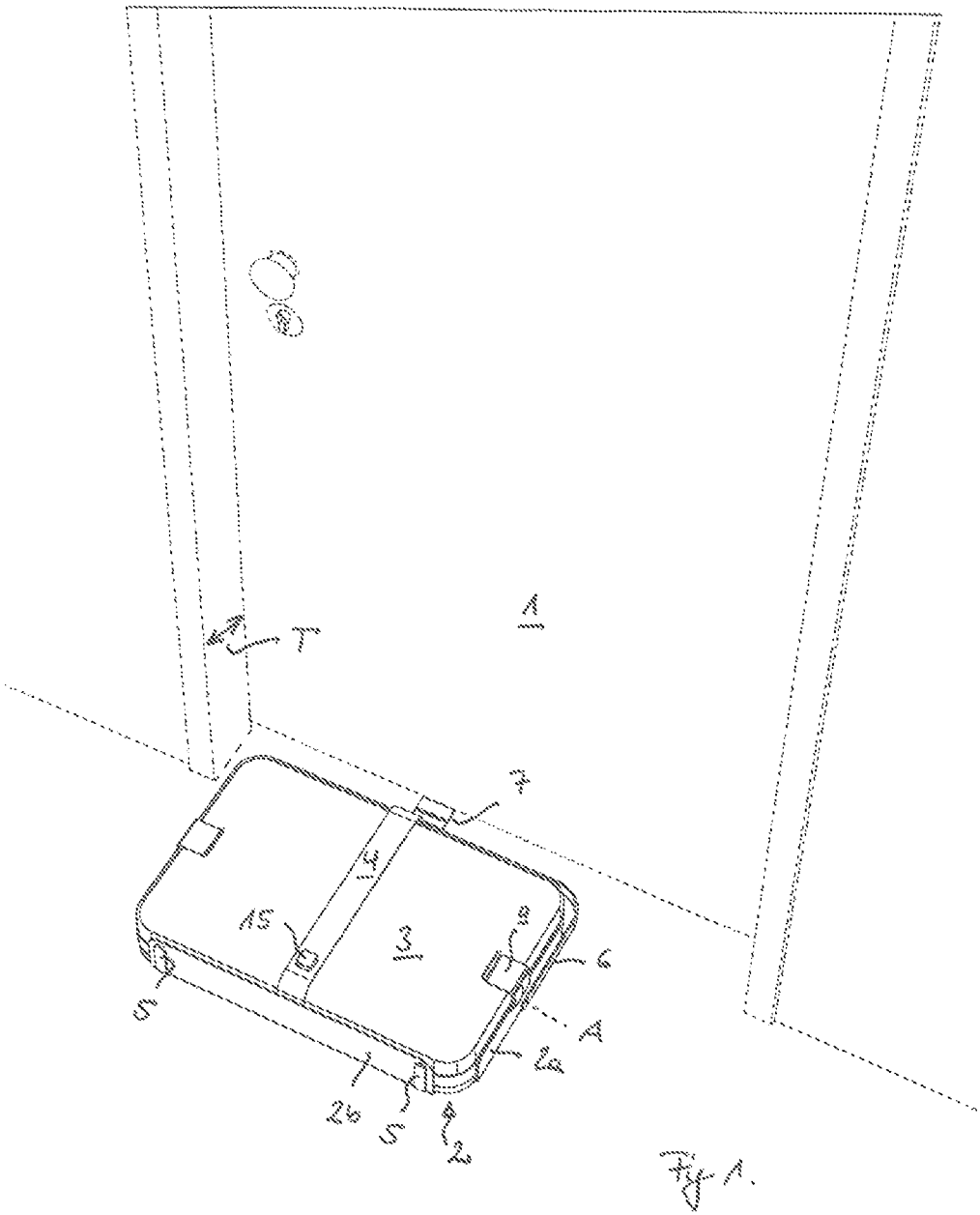
FIG. 1 depicts a container according to an embodiment of the invention in a completely folded state.

In the above mentioned state of the art, which provides foldable side walls of the rigid type, the problem arises that a container can only assume two states in a defined manner, namely the folded state, in which no packages or small parcels find a place in the container and the completely unfolded state, in which the side walls are unfolded and a maximum volume is accessed in the container, in order to insert packages or small parcels. Often, however, smaller packages or small parcels are inserted into such a container, which do not completely exhaust the entire volume, so that a container of the abovementioned known type takes up a volume that is far too large and in particular unnecessarily large in many cases.

An embodiment of the invention provides a container such that the interior volume provided for receiving packages or small parcels can ideally be adapted to the typical shapes of such packages and small parcels and furthermore, the possibility is opened up to bring a container of this type from a folded state not only into a completely unfolded state, but possibly also into a partially unfolded state, so that the container, after inserting of a package or a small parcel, takes up a smaller volume compared to its maximum possible volume, which is just sufficient for receiving the current package or small parcel mailing. In particular, it shall be provided here that a container of this type adjusts automatically to the required inner volume size with a defined shaping of the side walls.

An embodiment of the invention provides a container, which, in particular in the initially unused state, that is, as long as no package or small parcel is inserted therein, can be accommodated in front of a door in a manner which is as space-saving as possible.

According to an embodiment of the invention, the foldable side walls form a textile tube extending vertically between the base element and the lid element in the unfolded state, which tube defines an interior space with a horizontal, rectangular cross section.

This design has the particular advantage compared to the state of the art that, by means of the textile design of the tube, a folding thereof between the base element and the lid element is possible in all possible intermediate stages, which result between the minimally collapsed folding and the maximally pulled apart extension of the textile tube.

Furthermore, it is ensured by the rectangular cross section of the textile tube in the horizontal section that it defines an inner volume which is ideally adapted to the usual rectangular or cuboid cross-sectional shapes of typical package or small parcel mailings, so that, by means of the tube cross section in the horizontal direction and the altogether available tube length between the lid and the base element, the maximum package or small parcel size, which can be inserted into such a container according to an embodiment of the invention, is clearly defined.

In particular when smaller packages or small parcels are inserted into a container, the lid element can rest on the top side of the mailing arranged in the container after closing the lid, whereby the textile tube extending between the lid and the base element simultaneously collapses and surrounds the mailing in folds. The height of the container according to an embodiment of the invention is thus only slightly larger than the mailing received therein, so that such a container according to an embodiment of the invention is noticed as disrupting no more than necessary even with longer dwelling times in front of an apartment door, in particular in residential estates with several apartments.

In order to obtain a well-defined at least substantially rectangular cross section of the preferably completely unfolded textile tube in the horizontal direction, a preferred embodiment of the container can provide that the textile tube has four fold lines proceeding vertically between the base element and the lid element, which define the corner regions of the rectangular cross section, in particular wherein each fold line has a preferably stitched fold line edge facing outwardly with regard to the container interior.

A fold line edge in textile technology and in the description of the present invention is meant to be the edge resulting from a folding of a textile material, which results between two material surfaces folded toward each other, and around which the material surfaces have, in the viewing direction, a convex transition of their surfaces which then face away from each other.

In the description of the invention, all directions, if not expressly named differently, further relate to the intended positioning of the container with its base element on a floor, so that the lid element can be removed from this base element in the vertical direction and the textile tube can thus be completely unfolded. The statements "inside" and "outside" then relate to the position with regard to the surrounding volume of the container.

With the abovementioned vertically proceeding fold lines between the base element and the lid element, the folding will preferably take place in such a manner that the textile surface parts of the side walls of the textile tube extending on both sides of the fold line enclose an inner angle of about 90° and an outer angle of about 270°.

The smaller inner angle hereby faces the interior of the container. This horizontal rectangular cross section is thereby clearly defined by four fold lines arranged in the corner regions with a horizontal rectangular cross section. It thereby has to be mentioned that, due to the textile, flexible design of the side walls with the horizontally rectangular cross section described here, a rectangular horizontal cross section in the mathematical exact sense is not claimed, but that deviations by means of the textile flexibility are permitted here in any case.

In particular by means of a stitching of the vertically proceeding fold lines by means of a seam with a distance to the fold line edge, it is ensured that the textile tube maintains its substantially rectangular cross-sectional design permanently, that is, the fold definition, even with a long continuous use of such a container.

With this advantageous further development, which ensures a defined horizontal cross section, in particular with a completely unfolded textile tube, the problem can furthermore however occur that, in a completely folded state of the container, thus when the lid element rests in principle completely on the folded textile tube and thus indirectly on the base element, the position of the lid element and the distance of the lid element to the base element is undefined, as, during the movement of the lid element onto the base element, the manner in which the textile tube folds is uncontrolled.

A further preferred design compared to this can accordingly provide to define a manner in which the textile tube folds in a defined manner when folding, by means of further fold-defining measures in the side walls, preferably in at least 2 opposite and further preferred in all side walls.

A first possibility of the further development can provide for this that the two side walls of at least one pair of opposite side walls respectively has several, in particular equidistantly spaced apart, horizontally proceeding fold lines with alternating consecutive, preferably stitched fold line edges facing outwardly and inwardly in the vertical direction.

By means of such an alternating arrangement of fold line edges facing outwardly and inwardly, a so-called Liporello fold of the viewed two respectively opposite side walls is achieved. This type of fold can preferably be carried out at least with the two opposite longer side walls of the side walls with different lengths of a container according to an embodiment of the invention.

Hereby it can be effected in a defined manner that these side walls fold in a zig-zag shape or like a concertina when the lid element moves towards the base element and the inner volume of the container is decreased hereby. It is also ensured here that the fold line edges remain, even with a longer use of the textile tube, by means of a stitching of the fold line edge with a seam respectively proceeding parallel to the fold line edge.

In a completely unfolded state of the container according to an embodiment of the invention, the course of the textile side walls between the respective fold lines, at least with a distance to the respective fold line proceeds in such a manner that these substantially include an angle of about 180° around the fold line edges inside and outside. However, at the moment when the distance between the lid element and the base element is decreased, the definition of the position of the fold line, thus, if the corresponding edge faces outward or inward, effects that the textile surface regions arranged around a fold line edge superpose each other inwardly or outwardly.

Such an above-described Liporello fold can also be provided with the two other opposite side walls, thus e.g. the two short ones. In such a case, all side walls would be horizontal fold lines with fold line edges facing outward in an alternating sequence in the vertical direction. Thereby, a concertina-type fold of the textile tube can result in all side walls.

Another furthermore preferred embodiment design can also provide to select a deviating folding type with the two other side walls of a second pair of opposite side walls, as for example the short side walls, namely in such a manner that respectively several, in particular equidistantly spaced horizontal fold lines are also present, these however respectively have a preferably stitched fold line edge facing outwards, wherein each of these side walls has at least one field, preferably at least two superposed fields in the vertical direction, and each present field has two fold lines crossing in the field center point with a respectively inwardly facing preferably stitched fold line edge, which both also cross the center point of a horizontal fold line.

The crossing fold lines with inwardly facing fold line edge preferably respectively originate from a meeting point, in which a vertical fold line meets both horizontal fold lines with outwardly facing fold line edges of the two side walls with an angle of 90° to each other. The extension takes place through the mentioned center point to the diagonally opposite meeting point of similar fold lines as with the origin point.

This design also defines a preferred manner of folding with the other two side walls, when the lid element and the base element approach each other.

In particular, it is provided with this type of the previously described folding that each of the abovementioned present fields is divided into triangular partial fields arranged around a center point, wherein each triangular partial field abuts this center point with a triangle tip. The center point hereby defines the geometric field center and also the center of a horizontal fold line, in particular respectively of a fold line edge facing outward.

The triangular partial fields arranged above and below a horizontal fold line with an outer fold line edge or the center will then superpose with their outer sides during folding and a moving to the interior of the center point of this fold line or field, and simultaneously the outer triangular partial fields arranged on both sides around the fold line, of which one edge also proceeds along a vertical fold line, will superpose with their inner sides facing toward the interior of the container. The outer horizontal fold line edge regions thereby also move toward each other on both sides of the center point moving inwards.

In this implementation, in particular as a supplement to the previous implementation, it is preferably provided that at each height, at which the first pair of side walls has a horizontal fold line, the side walls of the second pair also have a horizontal fold line.

Thereby, a preferred further development can provide that each horizontal fold line of an aforementioned field extends, through the center point of which the crossing fold lines proceed and which has an outwardly facing fold line edge, on the abutting side wall at 90° thereto, at the same height, is provided a fold line with a reverse fold line, that is, with a fold line edge facing inwardly.

The folding of the textile tube is defined maximally hereby, so that it can also be ensured that, when folding the textile tube by moving the lid and base element toward each other, always the same manner of folding is achieved with the textile tube, therefore, the lid on the folded tube and the base element with a maximally folded position, a defined state is always achieved with respectively the same distance to the base element, viewed encompassing the lid element.

A compact folded container arrangement results hereby, wherein a locking between the base element and the lid element can be provided, in order to stabilize them in their position to each other and to form a folded container unit in this manner, which can be carried easily by a person in the form of hand luggage. For example, flaps can be fastened to the base element in an articulated manner for this, which flaps can be folded over the surface of the lid element.

An embodiment that can be combined with all above-mentioned embodiments can provide here that the textile walls comprise fire and/or cut-resistant threads such as Kevlar threads or are formed in several layers with at least one layer of Kevlar or in a further preferred implementation are formed completely of Kevlar. Fire protection regulations are adhered to hereby on the one hand, which are given in residential estates with several parties, and on the other hand it is also ensured that the textile tube cannot simply be cut in order to remove the contents of a container according to an embodiment of the invention.

The connection between the textile tube and the floor element or lid element can be performed by different implementations according to an embodiment of the invention.

With the connection of the textile tube at its bottom end, it can be provided, for example, that this bottom end is completely closed with a textile surface, thus for example with a surface of the base element arranged parallel to the floor, and this surface is connected to the base element, thus also, for example, with a surface of the base element arranged parallel to the floor, e.g. by screwing, gluing or other fastening measures.

Another alternative embodiment can also provide that the bottom-side tube end forms a loop in the circumferential direction, which is inserted into a frame, e.g. a metal frame, for example of aluminum, which is connected to the base element or a surface of the base element, e.g. by screwing or similar measures.

A further alternative implementation can also provide that the textile tube has a beading at its bottom end, preferably each side wall has its own beading extending in a straight line, which rests in a frame-shaped beading rail connected to the base element.

In the same or a similar manner it can also be provided that the textile tube forms a loop at its lid end, the loop extending in the circumferential direction in which rests a frame connected to the lid element in an articulated manner or that the side wall has at least one beading, preferably each side wall has its own straight beading, which rests in a frame-shaped beading rail connected to the lid element in an articulated manner.

Thus, with all of these embodiments, the lid element is connected in an articulated manner to the frame or the beading rail or another rigid arrangement, which is connected to the tube end at the lid side, in order to swivel the lid element with regard to this tube end, that is, to be able to open and close it. In particular, it can also be provided to realize a locking mechanism between the lid element, frame, beading rail or other rigid embodiment, which mechanism can only be opened when authorized.

Locking mechanisms can for example be provided hereby which can also be locked and unlocked by communication, as in the state of the art mentioned at the outset.

A further preferred embodiment can provide that the base element comprises a horizontal base plate in its intended use, with four upright side walls in the vertical direction, of which two are respectively parallel, in particular wherein these side walls can be formed in such a manner that they are not connected to each other in the corner regions. If a connection is provided here, the side walls form a substantially closed bowl with the base plate.

This bowl which is closed in the corners, or which is also open can serve, in the folded state of the container according to an embodiment of the invention, to cover at least the folded tube, possibly also a region of the lid element or of the frame connected thereto, further wherein an aforementioned locking mechanism can be provided at at least two of the abovementioned side walls, e.g. by rigid flaps fastened to the base element in an articulated manner, which flaps can rest on the upper side of the lid element, in order to fix the position of the lid element with regard to the base element in such a manner and to form a portable unit of the folded container.

A further development can also provide that one of the side walls, in particular one of the two mutually opposite long side walls, has a larger height than the other side walls, in particular namely such a height that at least substantially corresponds to the height between the lower surface of the base element and the upper surface of the lid element in the completely folded state of the textile tube. Especially this implementation makes it possible to form this side wall equipped with a larger height side as an installation support, in order to be able to install the entire folded container with a vertical orientation of the base element or its base plate, for example in order to install the folded container according to an embodiment of the invention in the depth of a door frame in front of a door prior to filling it with a package, without the folded container protruding into the space in front of the door frame, as e.g. in a hallway of a multi-storey residential building.

This ensures that a container which is still waiting for its filling by a package or a small parcel to be delivered, does not disturb other fellow occupants of such a house with several parties, especially that escape routes are also kept free.

To form the side wall of the installation support, it can further be provided that foot elements, for example of rubber or another elastomer are formed on this side wall at the outside.

The rigid components of the container according to an embodiment of the invention, in particular the base element and the lid element can preferably be made of aluminum or another light metal.

The lid element can further have a handle element in a preferred implementation in particular which extends between the two long sides or, alternatively, between the two short sides of the lid while forming an arch projecting from the lid.

A mailman can grip the container according to an embodiment of the invention at its handle, lift the lid element with regard to the base element and then open the lid element, in order to insert the package into the unfolded textile tube of the container. Thereafter, the lid element can be closed and placed onto the package or small parcel arranged in the container while automatically folding the textile tube.

In particular in order to enable a space-saving implementation of a secure fastening to a door of an apartment or of a house, the abovementioned object can also provide a solving implementation according to an embodiment of the invention of the container, in that the abovementioned generic container is further developed in that, at the base element, a fastening element, in particular a textile flap with at least one thickening is arranged indirectly via a swivel element arranged in an articulated manner at the base element, which can be inserted into the gap between a door leaf and the door frame or a door leaf and the floor.

By means of the swivel element arranged in an articulated manner between the fastening element and the base element it is ensured that the fastening element can be provided at the free end of the swivel element, which lies opposite to the end connected to the base element in an articulated manner, and thus, independently of the placement position of the container according to an embodiment of the invention, thus the placement on the floor surface of the base element or a side surface of the base element serving as an installation support, the free end of the swivel element can always be arranged close to the door, in order to introduce the fastening element arranged thereon, in particular a textile flap, in a door gap, either between the door gap and the frame or between the door leaf and the floor.

There also exists the possibility that a package carrier for the delivery of a package can tip the container, standing on a side surface as an installation support, placed in the depth of the door frame, by 90° for the delivery of a package, that is, place it onto the floor surface of the base element, wherein the swivel element is swiveled about its articulated fastening location at the base element and the container, placed in the correct manner for filling it, is hereafter unfolded, opened, filled, closed and possibly folded again partially.

A preferred further development can provide that the swivel element is designed as a U-shaped bracket, which is fastened with its leg ends to the base element in an articulated manner, for example, at two opposite side walls extending from the base plate at 90° to the floor surface, for example, at the short sides.

The implementation provides here that this bracket encloses the base element at least partially, in particular a long side of the base element completely with its base, and the two short sides with its legs at least partially, such as the abovementioned textile flap, preferably can be displaceably arranged at the bracket.

This fastening element can thus for example be displaced from the base region of the bracket into a leg region, depending on how the container according to an embodiment of the invention shall be positioned at a door frame and where in the door gap the fastening of the fastening element shall take place. In addition, a further provided useful implementation can also provide that the legs of the bracket can be adjusted in their length, e.g. are telescopic.

The axis of rotation of the articulation of the bracket can, in a preferred implementation, be arranged centrally in relation to its width, in particular, the articulation, as mentioned at the outset, can be made at the two opposite side walls, preferably the short side walls, centrally relative to the width, possibly also centrally to its height.

Another embodiment can also provide that the swivel element is formed of several, preferably at least three individual arms connected to each other in an articulated manner, which preferably have different lengths and wherein one of the arms connects the ends of two other arms in an articulated manner. Especially if this accumulation of arms having two arm ends is fastened simultaneously at a distance to the container floor, a defined forced guidance of the movable end of this multi-arm arrangement, wherein the fastening element, in particular a textile strap, can be arranged at a such positively-driven end.

Such a textile flap provided optionally with the different abovementioned versions can have at least one thickening. Accordingly, if a plurality of spaced thickenings is provided at the same time, there is the possibility to arrange one or more of the several thickenings in the interior and thereby define the distance of the container to the door.

Unless several thickenings are to be arranged simultaneously on a flap, it can also be provided that a textile flap has several openings into which a stop element can be inserted which forms the abovementioned thickening of the flap in such a manner that such a stop element cannot be pulled through the gap region between the door and the frame or the door and the floor. Such a stop element can therefore be arranged at different flap positions therein based on the length of a flap.

FIG. 1 shows a design of a container of the abovementioned type according to an embodiment of the invention in a completely folded state with an intended position in front of the door 1 of a property, that is, in a position in which a base element 2 rests on the floor in front of the door with its base surface.

It can be seen here that the base element has several side wall regions upstanding vertically from the base surface or base plate, of which the two side wall portions 2*a* and 2*b* can be seen, and further wherein the two side wall regions have no connection to each other in their corners.

The side wall 2*b* arranged on the long side of the base element 2 has a larger height here than the other side, in particular a height which corresponds to the folded height of the container between the bottom surface of the base element 2 and the top surface of the lid 3. Only the handle 4 projects in its height over this height of the side wall 2*b*.

It can further be seen that the side wall 2*b* has foot elements 5, such that the folded container can also be erected on this side wall, which then serves as the foot surface, for example to be arranged rotated by 90° in the depth T of the door frame.

The figure further shows that, at the two short opposite side walls 2*a*, which rise vertically from the bottom surface, a bracket 6 is fastened in an articulated manner around an axis of rotation A arranged centrally to the width of the base element 2.

The bracket 6 thus completely encompasses a long side of the container and the two opposite short sides approximately by half Here, a fastening element 7 is arranged at the base of the bracket 6, which extends through the gap between the door leaf and the floor into the interior of the apartment interior and has a thickening there, so that this fastening element 7 cannot be pulled to the outside through the gap region, thereby the container according to an embodiment of the invention is thus fixed locally.

By means of the swivelling of the bracket 6 around the axis A, there is thus also the possibility to place the container according to an embodiment of the invention in the folded state shown here onto the foot surface 2*b* vertically to the depicted position, wherein a swivelling of the bracket relative to the base element 2 takes place, the base of the bracket 6 substantially lies close to the floor and thus the positioning of the fastening element 7 does not experience any change. The container according to an embodiment of the invention can thus be brought into both possible positions in a locally fixed position.

Figure 2:
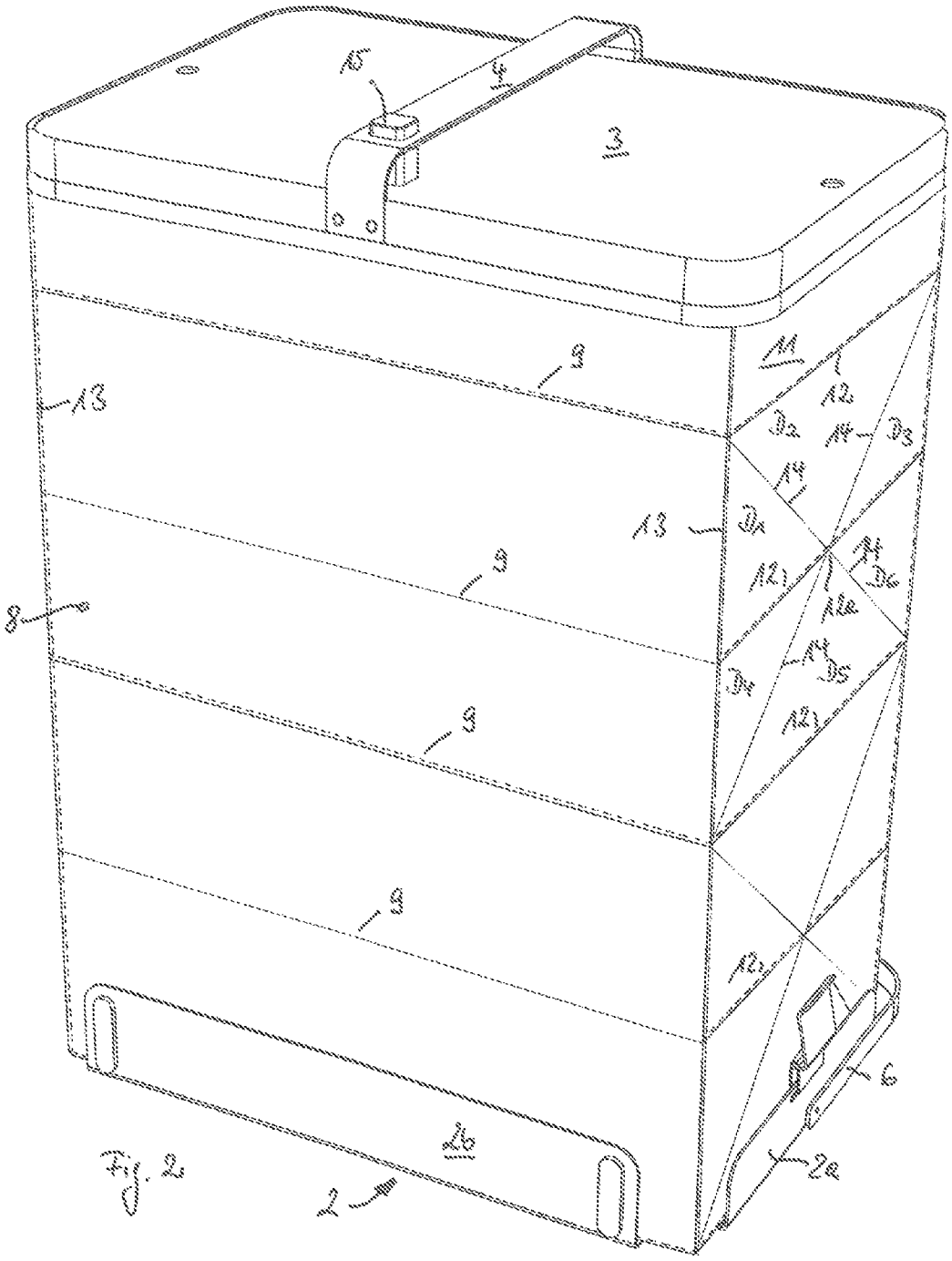
FIG. 2 depicts a container according to an embodiment of the invention in which a lid element is removed from a base element while a textile tube arranged between the lid and base is unfolded.

FIG. 2 now shows an embodiment of the container according to an embodiment of the invention, especially that of FIG. 1, which results in that the lid element 3 is removed from the base element 2 while unfolding the textile tube arranged between these elements.

For this, with respect to FIG. 1, the flaps 9 fastening the lid element 3 to the base element are removed or turned to the side so that the lid element is exposed and can be pulled upwards at the handle 4 in the vertical direction. Hereby, the textile tube, rectangular in its cross section, unfolds between the lid element and the base element, whereby a special folding definition is explained in greater detail below.

Figure 3:
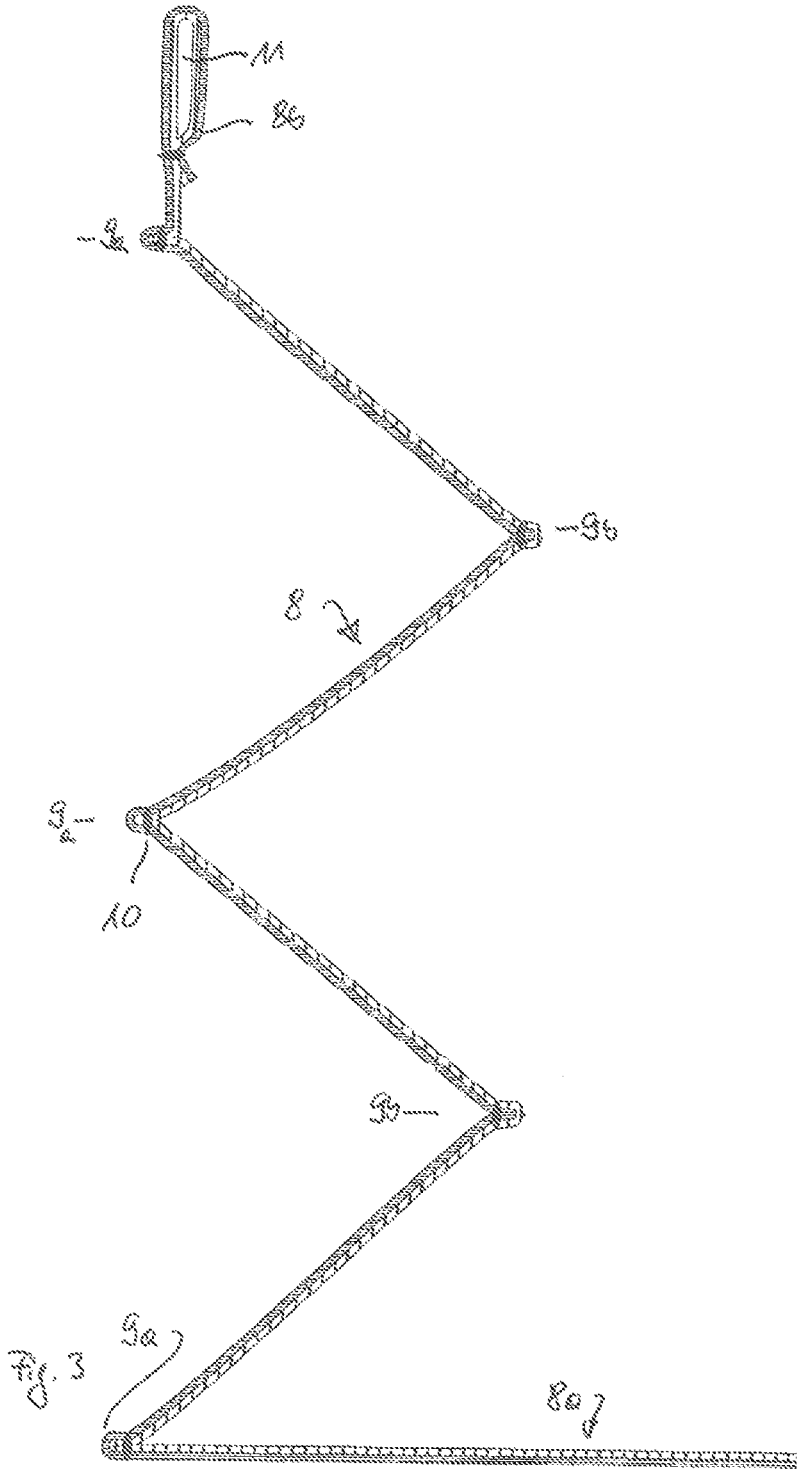
FIG. 3 depicts a sectional view of a container according to an embodiment of the invention in a not completely unfolded state.

It can be seen in FIG. 2, particularly also with respect to the further FIG. 3, which shows a sectional view through the long sides in the not yet completely unfolded state, that the long sides 8 of the textile tube have several equidistantly spaced horizontal fold lines 9.

In the vertical direction, the fold line edge 9 based on the interior of the container is oriented alternately inwardly or outwardly, that is, the convex rounded transition of the mutually folded textile surfaces is located alternately on the inside or the outside. With the fold lines 9*a*, the fold line edge is on the outside, with the fold lines 9*b*, it is on the inside.

Furthermore it is shown in the sectional view of FIG. 3, that in a preferred embodiment, each fold line 9 is stitched with a seam 10 with a distance to the fold line edge. The stitching by the shown seam 10 means hereby that the superposed textile surfaces are sewn together.

The embodiment according to FIG. 3 shown here further shows in section that a textile side wall can preferably also be formed in two layers, e.g. from an outer layer defining the visual design and a functional inner layer, which ensures e.g. fire resistance or cut resistance. Optionally, a single textile material layer can also combine these functions in itself.

The textile tube is closed by a textile surface 8*a* on the bottom side, which can be connected to the base element not shown in FIG. 3. On the upper side, however, the material tube forms a circumferential flap 8*b*, in which a frame 11 of the lid element can rest. The lid of the lid element is articulated to this frame for example.

By means of the folding shown in FIG. 3, which corresponds to a zig-zag or Liporello fold, therefore, a defined fold layer is achieved during unfolding, and especially during folding.

This type of fold can also be realized in the two side walls 8 at 90° to the side walls 11, however, a further preferred folding type of the other two side walls 11 is described below.

FIG. 2 also shows a perspective view of a special definition of the folds with the short side walls 11 abutting the long side walls 8 at an angle of 90°. It can be seen here that, at the same height position as with the side walls 8, the side walls 11 at 90° thereto have fold lines 12 in the horizontal direction, which are in turn equidistant and have all outer fold line edges, that is, the convex curves, into which the folded textile surfaces transfer into each other, face outwardly and are visualized here by a combined dotted and solid line, as is also the case with the vertically extending fold lines 13 defining the rectangular cross section.

By means of two such fold lines 12 and an intermediate further fold line 12, a field is defined in each case, which has further fold lines 14 crossing each other in the center point 12*a* of a horizontal fold line 12 or of the formed field and respectively originate from the field corners. These fold lines 14, which cross in the center point 12*a* of a horizontal fold line 12, have inwardly pointing fold line edges, which is visualized here by a simple solid line.

Hereby, in each of such a defined field, of which FIG. 2 has two superposed fields, six triangular partial fields $D_{1-6}$ are defined which enable a defined folding, namely in such a manner, that, when folding, the center point 12*a* of such a field, based on the container interior, migrates into the container and the triangular surfaces $D_{1-3}$ or $D_{4-6}$ are superposed with their outer sides, thus the outer sides of the triangular surface pairings $D_1$, $D_2$, $D_2$ and $D_3$, $D_4$ and $D_5$ and $D_5$ and $D_6$ contact each other. The triangular surfaces $D_1$ and $D_4$, and $D_3$ and $D_6$ lying on both sides of a fold line 12 with the center point 12*a*, which simultaneously have one of their sides coinciding with the vertical fold line 13, are superposed with their inner sides.

The provision of this type of fold lines, preferably with stitched fold line edges thereby clearly defines a predetermined manner how the textile tube behaves during folding. Thus the same folded state results which can be reproduced repeatedly.

FIG. 2 further visualizes that the lid element 3 has an actuating element 15 at its handle 4, with which the lid can be released. Such a release can for example take place at any time prior to inserting a package, however, it has to be released after inserting a package, for example, by sending a telecommunication, e. g. as text message or E-mail to a receiving element in the lid element 3. It can thus be provided for example that such a lid element 3 can be released or blocked by an application control, regarding the actuation of the actuating element 15.

The possibility to be able to open the lid element after locking it with a key in a classical manner can of course also exist.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A container for mailing a package or a small parcel to be sent or to be received, the container comprising:

a base element;

a lid element by which a mailing can be placed into the container or be removed from the container, and foldable side wails, by which the base element and the lid element are connected to each other;

wherein the lid element and the base element are movable against one another, at least in a vertical direction, by folding or at least partially unfolding the foldable side walls, wherein the foldable side walls form a textile tube vertically extending between the base element and the lid element in an unfolded state, the textile tube defining an interior space with an at least substantially horizontal rectangular cross section, wherein the textile tube has four fold lines proceeding vertically between the base element and the lid element, wherein the fold lines define corner regions of the rectangular cross section, and wherein each fold line has a stitched fold line edge facing outward with respect to the interior space.

2. The container according to claim 1, wherein the respective side walls of a first pair of opposite side walls of the foldable side walls respectively have several equidistantly spaced, horizontal fold lines with consecutive alternating fold line edges facing outward and inward with respect to the interior space.

3. The container according to claim 2, wherein the respective side walls of a second pair of opposite side walls of the foldable side walls respectively have several horizontal fold lines with an outward facing fold line edge, wherein each of the side wails of the second pair of opposite side walls has at least one field in the vertical direction, and wherein each of the at least one field has two fold lines crossing in a center point of the field and also in a center point of a horizontal fold line.

4. The container according to claim 3, wherein at each height at which the side walls of the first pair of side walls has a horizontal fold line, the side walls of the second pair of side walls also have a horizontal fold line.

5. The container according to claim 1, wherein the foldable side walls comprise fire-and cut-resistant threads.

6. A container for mailing a package or a small parcel to be sent or to be received, the container comprising:

a base element;

a lid element by which a mailing can be placed into the container or be removed from the container, and foldable side wails, by which the base element and the lid element are connected to each other;

wherein the lid element and the base element are movable against one another, at least in a vertical direction, by folding or at least partially unfolding the foldable side walls, wherein the foldable side walls form a textile tube vertically extending between the base element and the lid element in an unfolded state, the textile tube defining an interior space with an at least substantially horizontal rectangular cross section, and wherein the base element comprises a base plate with four vertically upright side walls, wherein the vertically upright side walls are not connected in the edge regions.

7. The container according to claim 6, wherein a first of the vertically upright side walls has a larger height than at least one other vertically upright side wall.

8. The container according to claim 7, wherein the first of the vertically upright side walls forms an installation support for the entire container with a vertical orientation of the base element.

9. A container for mailing a package or a small parcel to be sent or to be received, the container comprising:

a base element;

a lid element by which a mailing can be placed into the container or be removed from the container, and foldable side walls, by which the base element and the lid element are connected to each other;

wherein the lid element and the base element are movable against one another, at least in a vertical direction, by fielding or at least partially unfolding the foldable side walls, wherein the foldable side walls form a textile tube vertically extending between the base element and the lid element in an unfolded state, the textile tube defining an interior space with an at least substantially horizontal rectangular cross section, and wherein a textile flap fastening element with at least one thickening is arranged indirectly at the base element above a swivel element arranged in an articulated manner at the base element, wherein the textile flap fastening element can be inserted into a gap between a door leaf and a door frame or a door leaf and a floor.

10. The container according to claim 9, wherein the swivel element is formed as a U-shaped bracket fastened in an articulated manner to the base element the U-shaped bracket having legs that enclose the base element, and wherein the fastening element can be displaced at the bracket.

11. The container according to claim 10, wherein the legs of the U-shaped bracket can be adjusted in length, in particular telescopically.

12. The container according to claim 10, wherein an axis of rotation of the articulation of the U-shaped bracket is arranged at the base element centrally with regard to a width of the base element.

13. The container according to claim 9, wherein the swivel element is formed of at least 3 individual arms connected to each other in an articulated manner, wherein one of the arms connects the ends of two other arms in an articulated manner.

14. The container according to claim 2, wherein the side walls of the first pair of opposite side walls respectively have a Liporello fold.

15. The container according to claim 5, wherein the fire-and cut-resistant threads comprise Kevlar.

16. The container according to claim 7, wherein the larger height of the first of the vertically upright side walls has a height which substantially corresponds to the height between the bottom surface of the base element and the top surface attic lid element in the folded state of the textile tube.

17. The container according to claim 6, wherein a textile flap fastening element with at least one thickening is arranged indirectly at the base element above a swivel element arranged in an articulated manner at the base element, wherein the textile flap fastening element can be inserted into a gap between a door leaf and a door frame or a door leaf and a floor, and wherein an axis of rotation of the articulation of two of the four vertically upright side walls is arranged at the base element centrally with regard to a width of the base element.

* * * * *